US008016603B1

(12) United States Patent
Tsai et al.

(10) Patent No.: US 8,016,603 B1
(45) Date of Patent: Sep. 13, 2011

(54) QUICK-CONNECTION OUTDOOR WATERPROOF ELECTRICAL CONNECTOR

(75) Inventors: Chih-Hung Tsai, Keelung (CN); Mingyue Li, Wujiang (CN)

(73) Assignee: Leoco (Suzhou) Precise Industrial Co., Ltd, Wujiang (CN)

( * ) Notice: Subject to any disclaimer, the term of this patent is extended or adjusted under 35 U.S.C. 154(b) by 0 days.

(21) Appl. No.: 12/906,641

(22) Filed: Oct. 18, 2010

(30) Foreign Application Priority Data

Jun. 2, 2010 (CN) ..... 2010 1 0189050

(51) Int. Cl.
*H01R 13/52* (2006.01)

(52) U.S. Cl. ..... 439/271

(58) Field of Classification Search ..... 439/271, 439/352, 355
See application file for complete search history.

(56) References Cited

U.S. PATENT DOCUMENTS 5,735,704 A * 4/1998 Anthony ..... 439/271
2008/0194137 A1* 8/2008 Kuo ..... 439/489

* cited by examiner

*Primary Examiner* — Javaid Nasri
(74) *Attorney, Agent, or Firm* — Oliff & Berridge, PLC

(57) ABSTRACT

A quick-connection outdoor waterproof electrical connector is provided, having the following features: All of the male terminals and the female terminals are all positioned in a peripheral direction with the same diameter; the female terminal is provided at its connection portion with a "U-shaped" structure; for the internal wall of the cylindrical hole and the external edge of the cylindrical plug, one is provided with an "L-shaped" guide slot and the other with a convex guide pole, with the cylindrical hole being provided at its bottom with an end-plane waterproof washer.

7 Claims, 8 Drawing Sheets

QUICK-CONNECTION OUTDOOR WATERPROOF ELECTRICAL CONNECTOR

FIELD OF THE INVENTION

The present invention relates to an electrical connector, particularly to a quick-connection outdoor waterproof electrical connector. This electrical connector, especially suitable for outdoor applications, is characterized by quick connection, waterproofness, corrosion resistance, ultraviolet resistance, humidity resistance and so on.

BACKGROUND OF THE INVENTION

The electrical connector is widely used as a connection device for a power supply or an electrical signal between electronic devices and electronic instruments as well as in the network communication. When the electrical connector is used outdoors, the requirement for its connection performance and function is higher because of the environmental influence. For example, the electrical connector should possess such functions as waterproofness, corrosion resistance, ultraviolet resistance, and humidity resistance in addition to good electrical connection performance. Therefore, how to design this electrical connector will directly affect the outdoor installation and the application effect.

One of the typical structures of the current outdoor electrical connector is shown in FIGS. 1 and 2. This outdoor electrical connector is mainly composed of a male joint 14, a female joint 15 and a thread jacket 16. The male joint 14 is provided at its connection end with a concave cylindrical hole 17 for connection, inside which is positioned a male bar terminal 8 in parallel with the axis, the male bar terminal (8) being suspended at its front in the cylindrical hole 17 and fixed at its rear in the male joint 14. The female joint 15 is provided at its connection end with a convex cylindrical plug 18 fittedly connected with the cylindrical hole 17, the cylindrical plug 18 being provided inside with a terminal mounting hole in parallel with the axis, the terminal mounting hole being provided inside with a female bar terminal 2. The male terminal 8 and the female terminal 2 are provided in pairs, with at least two pairs. During application, the male joint 14 and the female joint 15 are oppositely inserted into each other, and then the thread jacket 16 is rotated to get both tightly fixed. Here, the shell of the male contact 14 and the shell of the female joint 15 form a closed structure, where the male terminal 8 and the female terminal 2 are connected with each other one to one in line. This outdoor electrical connector has the following shortcomings: 1. The male and the female terminals are connected by a hole-and-shaft in-line structure. Because the female terminal is in point contact with the external edge of the male terminal through an elastic sheet, reliability of the contact between the terminals is reduced due to the elastic sheet that is inclined to suffer metal fatigue, especially when the outdoor temperature and humidity change greatly, which is inclined to result in a poor contact. 2. After the male joint and the female joint are oppositely inserted into each other, the thread jacket has to be rotated repeatedly to get both of them tightly fixed, which makes the assembly minute and complicated and thus brings inconvenience to construction and operation. 3. The waterproofness and humidity resistance are not good. 4. The male joint and the female joint are not provided after the connection with a safety lock for preventing illegal disassembly.

CONTENTS OF THE INVENTION

1. The present invention provides a quick-connection outdoor waterproof electrical connector. The first purpose is to improve the electrical connection reliability and the waterproof performance of the electrical connector; the second purpose is to improve the assembly performance of the electrical connector, making the outdoor assembly simple and reliable; and the third purpose is to improve the safety of the outdoor electrical connector for preventing illegal disassembly.

In order to attain the above-mentioned purposes, a technical solution of the present invention is as below: A quick-connection outdoor waterproof electrical connector is provided, including a male joint and a female joint.

The male joint is provided at its connection end with a concave cylindrical hole for connection, inside which is positioned a male bar terminal in parallel with the axis, the male bar terminal being suspended at its head in the cylindrical hole and fixed at its base in the male joint.

The female joint is provided at its connection end with a convex cylindrical plug fittedly connected with the cylindrical hole, the cylindrical plug being provided inside with a terminal mounting hole in parallel with the axis, the terminal mounting hole being provided inside with a female bar terminal.

The male terminal and the female terminal are provided in pairs, with at least two pairs.

It is innovative on the following aspects: On the radial section of the cylindrical hole, all the male terminals are positioned in a peripheral direction with the center of the cylindrical hole as the center of a circle; and on the radial section of the cylindrical plug, all the female terminals are positioned in a peripheral direction with the center of the cylindrical plug as the center of a circle; and the periphery where the male terminal is positioned has the same diameter with that where the female terminal is positioned.

A connection portion of the male terminal is of a bar structure, while the female terminal is provided at its connection portion with a "U-shaped" structure for the bar structure to be embedded laterally. The "U-shaped" opening is counterclockwise or clockwise in the tangent direction of the periphery where the female terminal is positioned. A terminal mounting hole is provided opposite to the "U-shaped" opening with an accommodation space for the bar structure to be inserted axially.

For the internal wall of the cylindrical hole and the external edge of the cylindrical plug, one is provided with an "L-shaped" guide slot composed of an axial guide slot and a peripheral guide slot connected with each other, and the other with a convex guide pole.

The cylindrical hole is provided at its bottom with an end-plane waterproof washer.

When the male joint is connected with the female joint, the convex guide pole is in alignment with the axial guide slot of the "L-shaped" guide slot, making the cylindrical plug inserted into the cylindrical hole; meanwhile, the bar structure of the connection portion of the male terminal is inserted into the accommodation space in front of the "U-shaped" opening of the female terminal; here, with the male joint and the female joint pressing each other, the end-plane waterproof washer forms the end-plane waterproof seal between the bottom of the cylindrical hole and the end plane of the cylindrical plug; when the cylindrical plug is rotated counterclockwise, or clockwise by an azimuth relative to the cylindrical hole, the convex guide pole glides along the peripheral guide slot of the "L-shaped" guide slot, and meanwhile the bar structure of the connection portion of the male terminal is embedded laterally from the connection portion of the female terminal into the "U-shaped" structure to form the electrical connection.

The explanation for the relevant contents of the above technical solution is as below:

1. In the above solution, the "connection end of the male joint" and the "connection end of the female joint" refer to the end portions of the male and the female joints where they are connected with each other. The "connection portion of the male terminal" and the "connection portion of the female terminal" refer to the portions of the male and the female terminals where they are connected with each other.

2. In the above solution, the expression, "for the internal wall of the cylindrical hole and the external edge of the cylindrical plug, one is provided with an "L-shaped" guide slot composed of an axial guide slot and a peripheral guide slot connected with each other, and the other with a convex guide pole", includes two cases: The first is that the cylindrical hole is provided on its internal wall with the "L-shaped" guide slot, while the cylindrical plug on its external edge with the convex guide pole; and the second is that the cylindrical plug is provided on its external edge with the "L-shaped" guide slot, while the cylindrical hole on its internal wall with the convex guide pole.

3. In the above solution, in order to improve the function of the "L-shaped" guide slot and the convex guide pole, the "L-shaped" guide slot and the convex guide pole are composed of at least two pairs, each pair of them being composed of one "L-shaped" guide slot and one convex guide pole, at least two pairs of the "L-shaped" guide slots and the convex guide poles being positioned evenly in a peripheral direction.

4. In the above solution, in order to improve the fitting effect of the "L-shaped" guide slot and the convex guide pole, the guide side of the peripheral guide slot is designed as an inclined plane, whose direction of turning forces the bottom of the cylindrical hole and the end plane of the cylindrical plug to press tightly against the end-plane waterproof washer. The peripheral guide slot is provided at its end with a concave portion for positioning the convex guide pole.

5. In the above solution, in order to improve the waterproof effect, between the internal wall of the cylindrical hole and the external edge of the cylindrical plug can be positioned an "O-shaped" waterproof ring, which is positioned in an annular concave slot located in one of the internal wall of the cylindrical hole and the external edge of the cylindrical plug, and forms the peripheral waterproof seal by being in contact with the other of the internal wall of the cylindrical hole and the external edge of the cylindrical plug. There may be one, two, three and more "O-shaped" waterproof rings, until the desired sealing effect is obtained.

6. In the above solution, in order to prevent others from illegally disassembling the electrical connector, a lock catch mechanism can be provided to lock the electrical connector after the male joint is connected with the female joint. This lock catch mechanism is as below: A male lock ear is extended in the radial direction along the external edge of the male joint, and provided with a male lock hole; a female lock ear is extended in the radial direction along the external edge of the female joint, and provided with a female lock hole; a lock catch is mainly composed a lock bolt and a lock tube, the lock bolt being composed sequentially in a length direction of three integral sections of a lock head, a lock rod and a lock seat; a shaft shoulder is positioned where the lock head is connected with the lock rod to prevent the lock head from receding; the lock tube is mainly of a sleeve structure, inside which are positioned at least two sectional jaws; after the lock head of the lock bolt goes through the male lock hole and the female lock hole and is inserted into the sleeve of the lock tube, the jaw is caught at the shaft shoulder behind the lock head, thus forming a lock catch mechanism preventing the lock bolt from receding.

7. In the above solution, in order to prevent the male joint and the female joint from being polluted with such impurities as dust and water vapor in a disassembly state, the male joint is provided with a male dustproof plug, which is mainly composed of a plug body, which is plugged into the cylindrical hole of the male joint to form a seal structure. The female joint is provided with a female dustproof cover, which is mainly composed of a sleeve cover with one end sealed, the sleeve cover being sleeved on the cylindrical plug of the female joint to form a seal structure.

Because of application of the above technical solution, the present invention has the following advantages and effects compared with the prior art:

1. In the present invention, the hole-and-shaft in-line connection structure of the male terminal and the female terminal is changed to the rotation embedded connection structure, and the male terminal and the female terminal are all positioned in the same peripheral direction. When the cylindrical plug is rotated counterclockwise or clockwise by an azimuth relative to the cylindrical hole, the bar structure of the connection portion of the male terminal is embedded laterally from the connection portion of the female terminal into the "U-shaped" structure to form the electrical connection. Because a face contact with the good clamping effect is formed between the "U-shaped" structure of the female terminal and the bar structure of the male terminal, the reliability of the contact between the terminals is improved, thus guaranteeing the electrical conductive effect between the terminals.

2. In the present invention, a guide connection structure, where the "L-shaped" guide slot is fitted with the convex guide pole, is provided between the cylindrical hole of the male joint and the cylindrical plug of the female joint. When the male joint is connected with the female joint, the convex guide pole is in alignment with the axial guide slot of the "L-shaped" guide slot, making the cylindrical plug inserted into the cylindrical hole; meanwhile, the bar structure of the connection portion of the male terminal is inserted into the accommodation space in front of the "U-shaped" opening of the female terminal; when the cylindrical plug is rotated counterclockwise or clockwise by an azimuth relative to the cylindrical hole, the convex guide pole glides along the peripheral guide slot of the "L-shaped" guide slot, and meanwhile the bar structure of the connection portion of the male terminal is embedded laterally from the connection portion of the female terminal into the "U-shaped" structure to form the electrical connection. This shows that the guide connection structure design according to the present invention, compared with the prior art in-line connection plus rotation thread jacket tightening, is simple and reliable in operation, and thus brings convenience to outdoor construction and operation.

3. The cylindrical hole according to the present invention is provided at its bottom with an end-plane waterproof washer. When the cylindrical plug is inserted into the cylindrical hole, with the male joint and the female joint pressing each other, the end-plane waterproof washer forms the end-plane waterproof seal between the bottom of the cylindrical hole and the end plane of the cylindrical plug. This end-plane waterproof seal can effectively isolate the male terminal and the female terminal from outside, and thus has good waterproof and humidity resistant performances. In addition, between the internal wall of the cylindrical hole and the external edge of the cylindrical plug is positioned an "O-shaped" waterproof ring, which can further improve the waterproof effect and meet the requirement of the IP68 waterproof grade test.

4. In the present invention, in order to prevent others from illegally disassembling the electrical connector, a lock catch mechanism is provided to lock the electrical connector after the male joint is connected with the female joint. This lock catch mechanism can effectively prevent others from illegally disassembling the electrical connector to filch a cable or modify data.

5. In the present invention, in order to prevent the male joint and the female joint from being polluted with such impurities as dust and water vapor in a disassembly state, the male joint is provided with a male dustproof plug, and the female joint with a female dustproof cover, which have a good dustproof effect.

In the above drawings: 1. Multicore wire; 2. female terminal; 3. female external mold; 4. female rubber core; 5. lock catch; 6. end-plane waterproof washer; 7. male external mold; 8. male terminal; 9. multicore wire; 10. male dustproof plug; 11. male rubber core; 12. "O-shaped" waterproof ring; 13. female dustproof cover; 14. male joint; 15. female joint; 16. thread jacket; 17. cylindrical hole; 18. cylindrical plug; 19. terminal mounting hole; 20. bar structure; 21. "U-shaped" structure; 22. accommodation space; 23. "L-shaped" guide slot; 24. convex guide pole; 25. inclined plane; 26. concave portion; 27. annular concave slot; 28. male lock ear; 29. male lock hole; 30. female lock ear; 31. female lock hole; 32. lock bolt; 33. lock tube; 34. lock head; 35. lock rod; 36. lock seat; 37. shaft shoulder; and 38. jaw.

DETAILED DESCRIPTION OF THE EMBODIMENTS

The present invention will further be described below with reference to drawings and embodiments.

Embodiment: A quick-connection outdoor waterproof electrical connector

Figure 1:
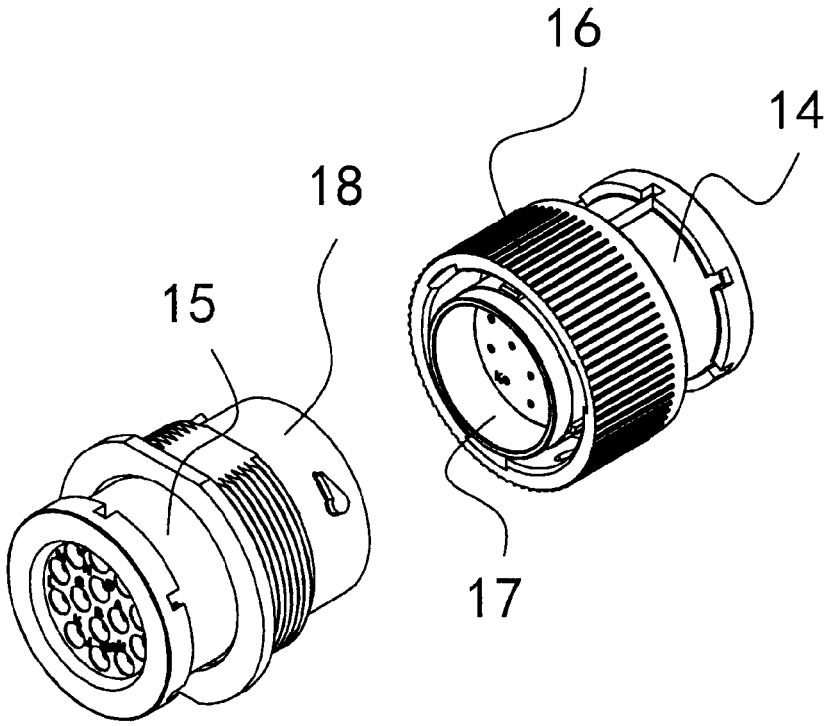
Fig. 1 Prior Art
FIG. 1 is a stereoscopic drawing of the male and the female joints of the prior art outdoor electrical connector.
Figure 2:
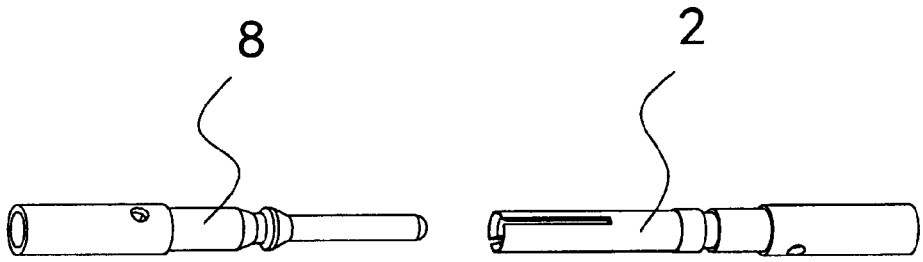
Fig. 2 Prior Art
FIG. 2 is a stereoscopic drawing of the male and the female terminals of the prior art outdoor electrical connector.
Figure 3:
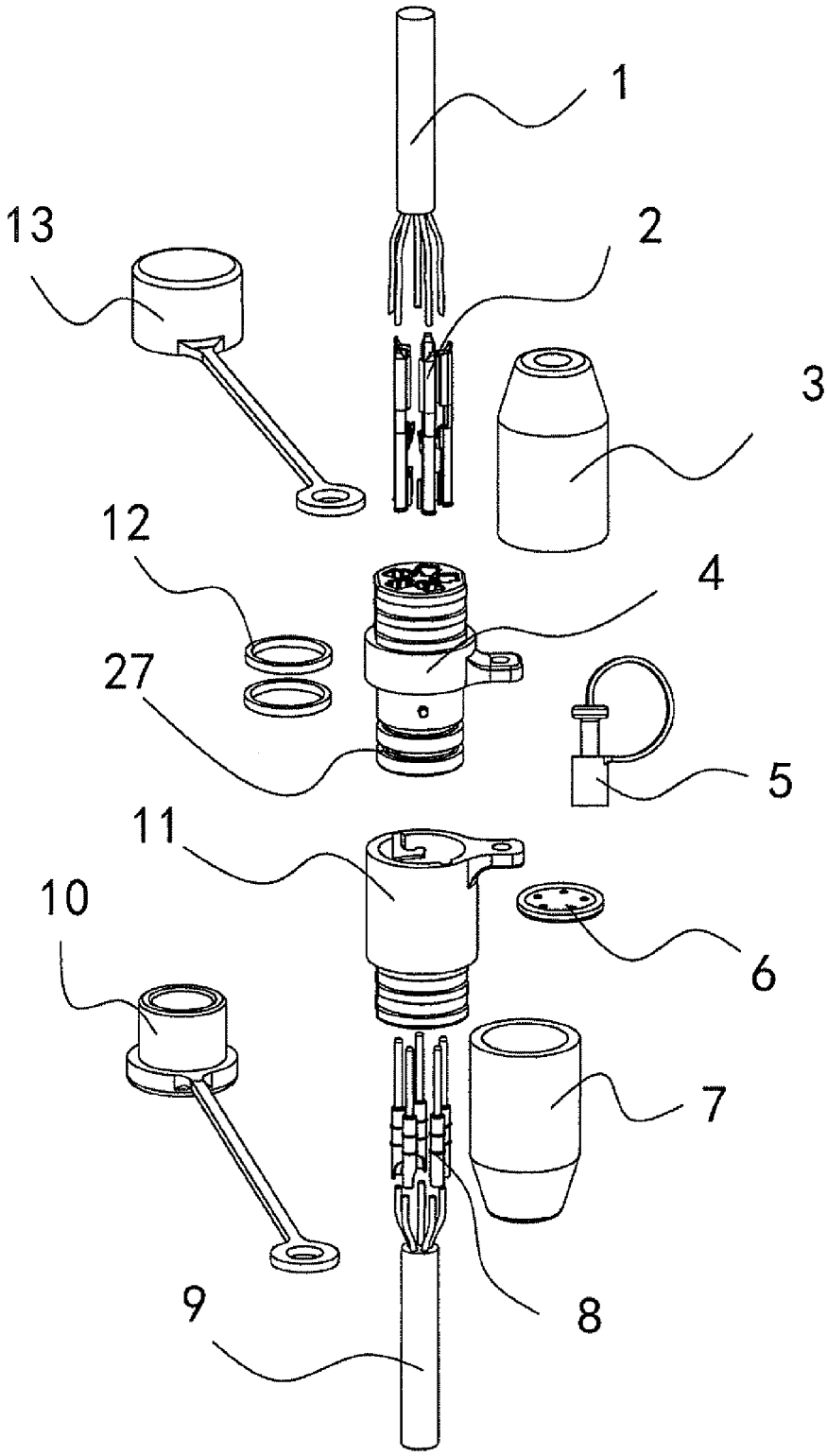
FIG. 3 is a stereoscopic exploded drawing of the embodiment according to the present invention.
Figure 4:
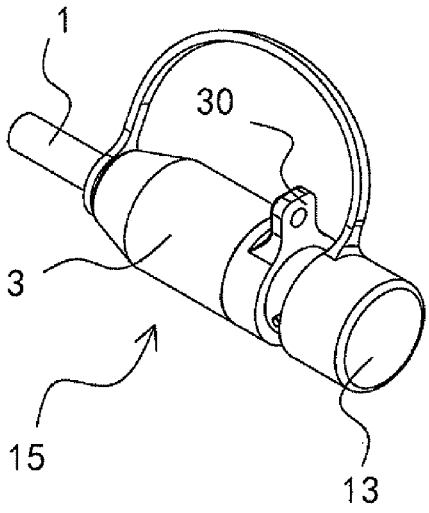
FIG. 4 is a stereoscopic drawing of the female joint according to the embodiment of the present invention.
Figure 5:
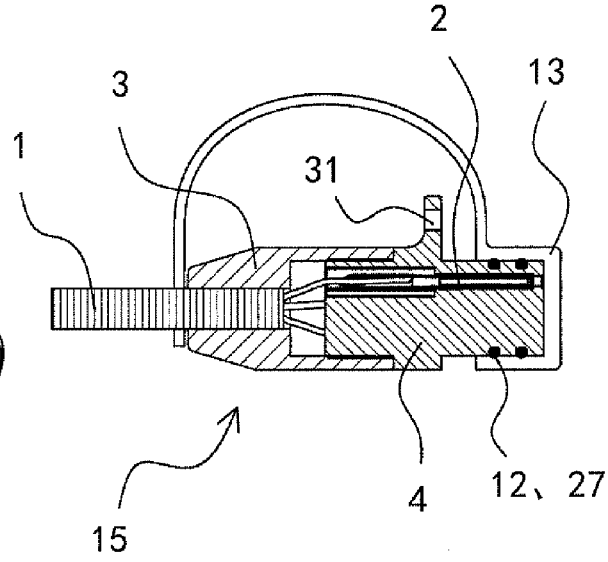
FIG. 5 is a sectional view of the female joint according to the embodiment of the present invention.
Figure 6:
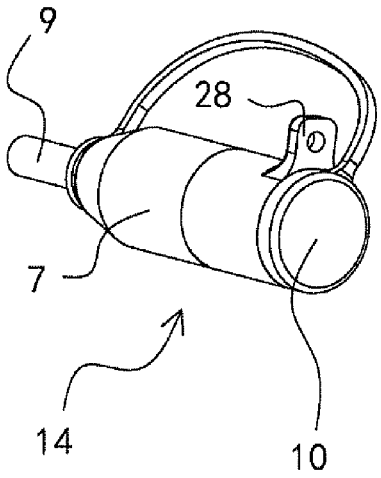
FIG. 6 is a stereoscopic drawing of the male joint according to the embodiment of the present invention.
Figure 7:
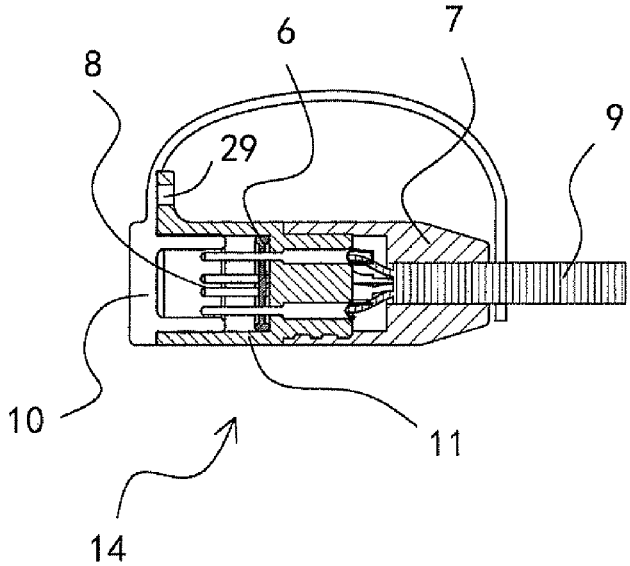
FIG. 7 is a sectional view of the male joint according to the embodiment of the present invention.
Figure 8:
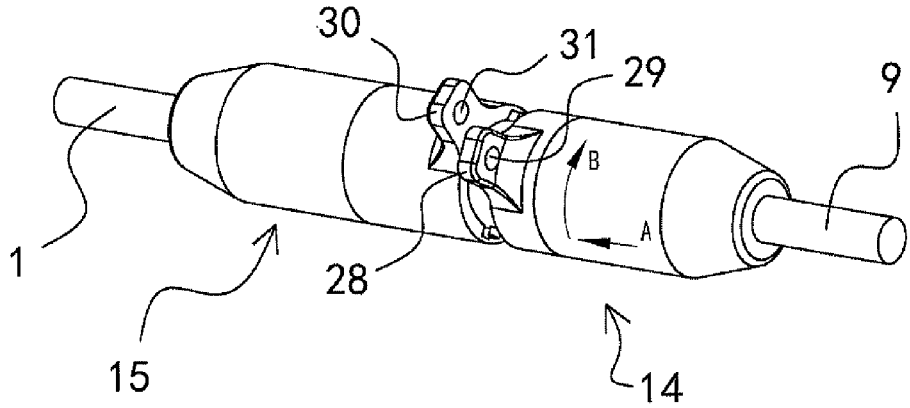
FIG. 8 is a schematic view of the male and the female joints according to the embodiment of the present invention during the assembly process.
Figure 9:
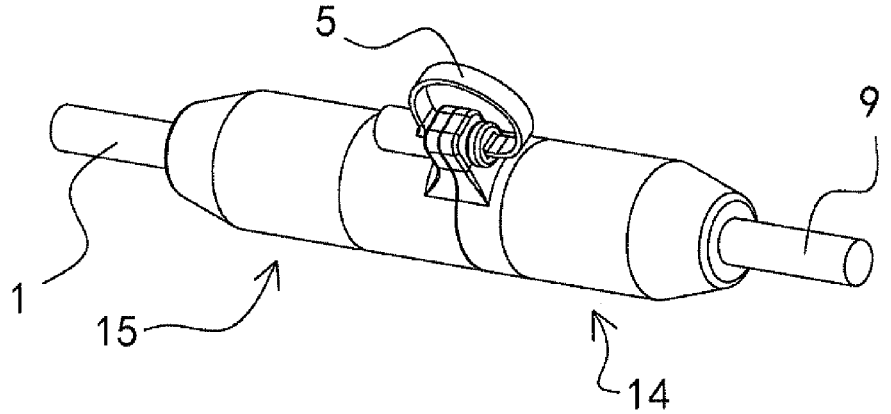
FIG. 9 is a stereoscopic drawing of the male and the female joints according to the embodiment of the present invention after the assembly is finished.
Figure 10:
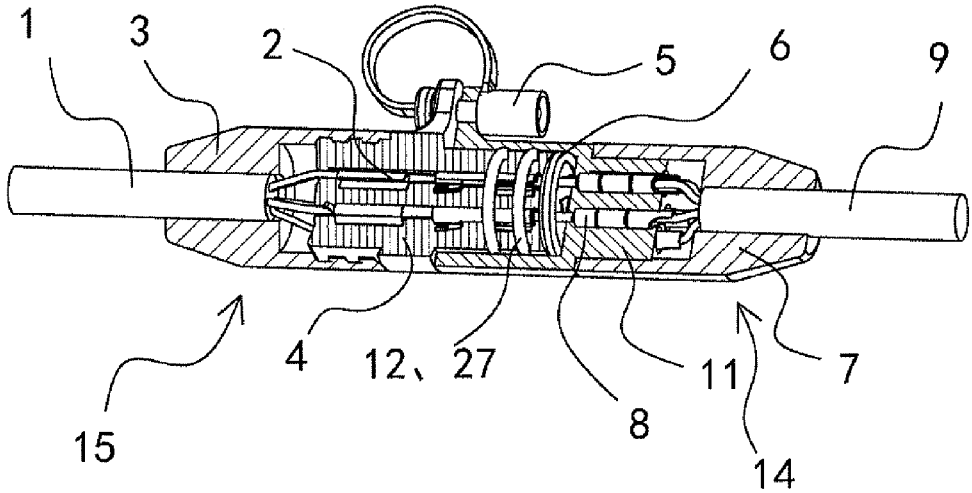
FIG. 10 is a sectional view of the male and the female joints according to the embodiment of the present invention after the assembly is finished.
Figure 11:
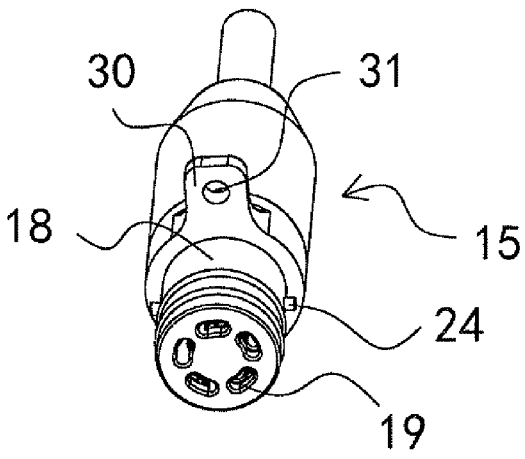
FIG. 11 is a stereoscopic drawing of the female joint according to the embodiment of the present invention after the dustproof cover is opened.
Figure 12:
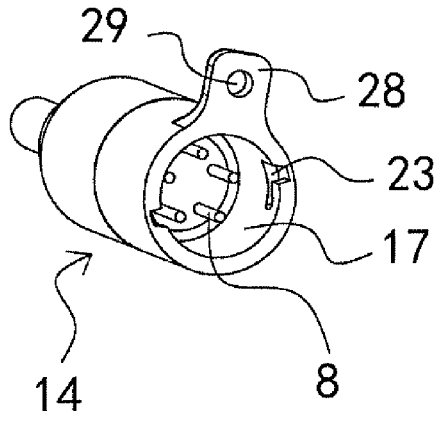
FIG. 12 is a stereoscopic drawing of the male joint according to the embodiment of the present invention after the dustproof plug is opened.
Figure 14:
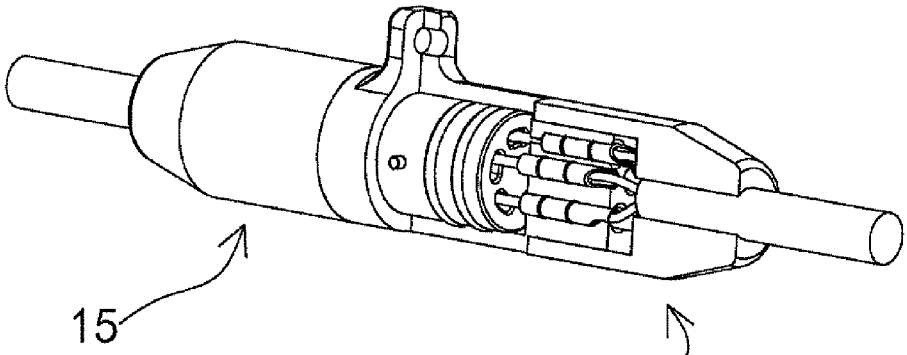
FIG. 14 is an internal schematic view of the male and the female joints according to the embodiment of the present invention after the assembly is finished.
Figure 15:
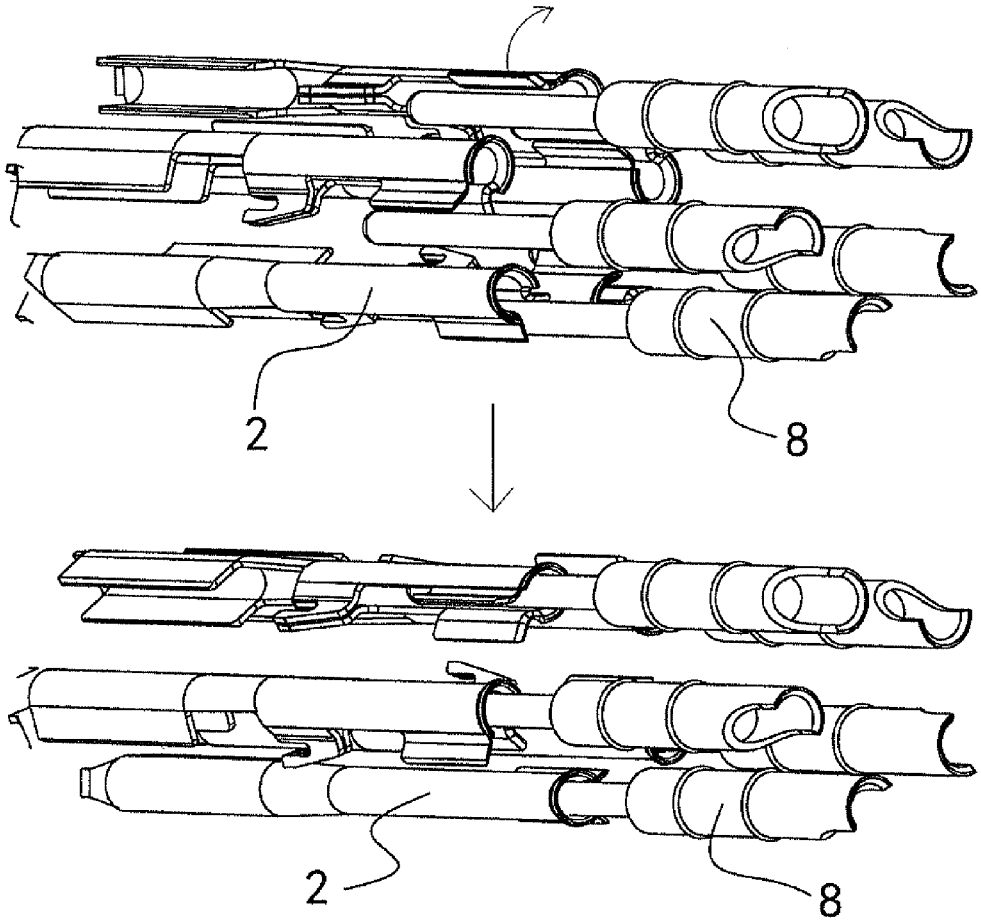
FIG. 15 is a stereoscopic drawing of a group of the male terminals and a group of the female terminals inside the electrical connector according to the embodiment of the present invention during the one-to-one connection process.
Figure 16:
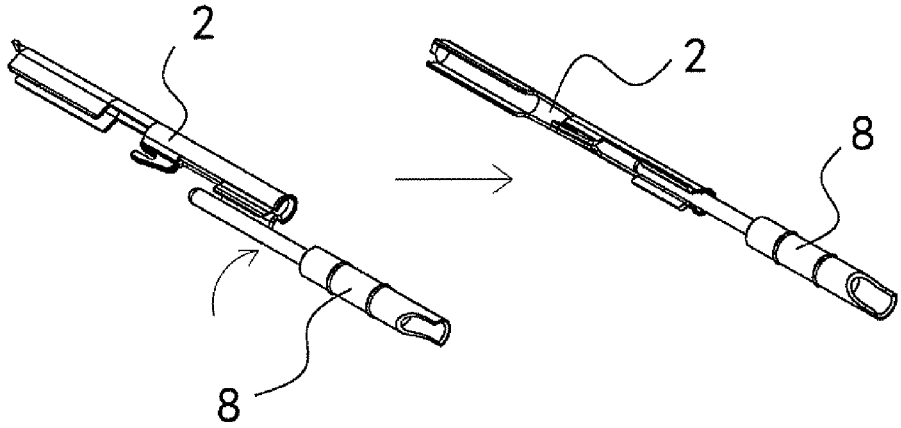
FIG. 16 is a stereoscopic drawing of a pair of the male and the female terminals according to the embodiment of the present invention during the connection process.

As shown in FIGS. 3~23, this quick-connection outdoor waterproof electrical connector includes a male joint 14 and a female joint 15 (see FIGS. 8~10). The male joint 14 is provided at its connection end with a concave cylindrical hole 17 for connection (see FIG. 12), inside which is positioned a male bar terminal 8 in parallel with the axis, the male bar terminal (8) being suspended at its head in the cylindrical hole 17 and fixed at its base in the male joint 14. The male joint 14 is composed of a male external mold 7 and a male rubber core 11 (see FIGS. 3 and 10). The female joint 15 is composed of a female external mold 3 and a female rubber core 4 (see FIGS. 3 and 10), and provided at its connection end with a convex cylindrical plug 18 fittedly connected with the cylindrical hole 17 (see FIG. 11), the cylindrical plug 18 being provided inside with a terminal mounting hole 19 in parallel with the axis (see FIG. 11), each of the terminal mounting holes 19 being provided inside with one female bar terminal 2. The male terminal 8 and the female terminal 2 are provided in pairs, with five pairs (there are five pairs of the terminals in this embodiment; however, the pair number of the terminals can be determined as required, with least two pairs). On the radial section of the cylindrical hole 17, five male terminals 8 are positioned evenly in a peripheral direction with the center of the cylindrical hole 17 as the center of a circle (see FIG. 12). On the radial section of the cylindrical plug 18, five female terminals 2 are positioned evenly in a peripheral direction with the center of the cylindrical plug 18 as the center of a circle (see FIG. 17). The periphery where the male terminal 8 is positioned has the same diameter with that where the female terminal 2 is positioned (see FIG. 15). A connection portion of the male terminal 8 is of a bar structure 20, while the female terminal 2 is provided at its connection portion with a "U-shaped" structure 21 for the bar structure 20 to be embedded laterally (see FIGS. 16 and 17; the "U-shaped" structure in this embodiment is specifically of an " " shape, making both sides of the embedding mouth elastic). The "U-shaped" opening is counterclockwise (or clockwise) in the tangent direction of the periphery where the female terminal 2 is positioned (see FIG. 17), and a terminal mounting hole 19 is provided opposite to the "U-shaped" opening with an accommodation space 22 for the bar structure 20 to be inserted axially (see FIG. 17). The cylindrical hole 17 is provided on its internal wall with an "L-shaped" guide slot 23 composed of the axial guide slot and the peripheral guide slot connected with each other (see FIG. 19), and the cylindrical plug 18 at its external edge with a convex guide pole 24 (see FIG. 19). Theoretically, the "L-shaped" guide slot 23 can also be positioned at the external edge of the cylindrical plug 18, while the convex guide pole 24 on the internal wall of the cylindrical hole 17. The cylindrical hole 17 is provided on its bottom with an end-plane waterproof washer 6 (see FIGS. 7 and 10), while two "O-shaped" waterproof rings 12 are positioned between the internal wall of the cylindrical hole 17 and the external edge of the cylindrical plug 18 (see FIGS. 10, 13 and 14). The "O-shaped" waterproof ring 12 is positioned in an annular concave slot 27 at the external edge of the cylindrical plug 18, and forms two rounds of the peripheral waterproof seal by contacting with the internal wall of the cylindrical hole 17.

Figure 13:
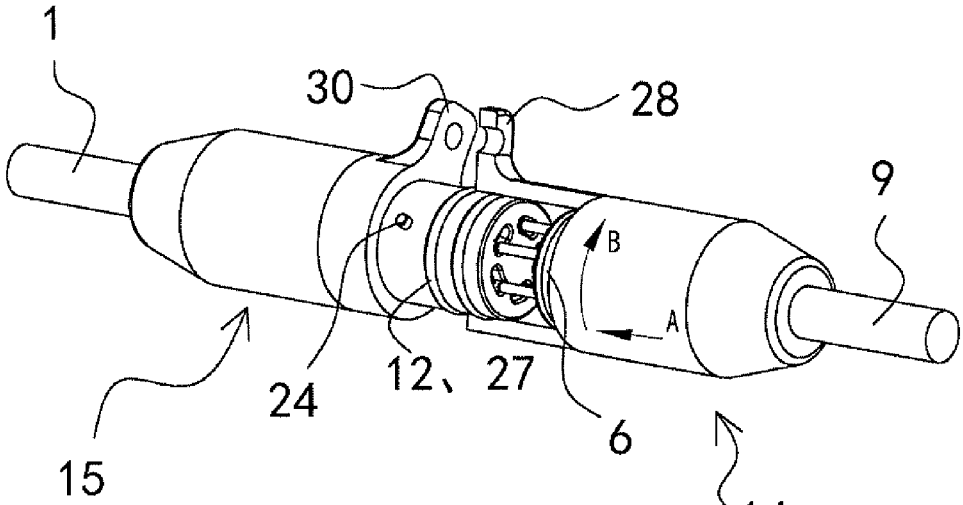
FIG. 13 is an internal schematic view of the male and the female joints according to the embodiment of the present invention during the assembly process.
Figure 19:
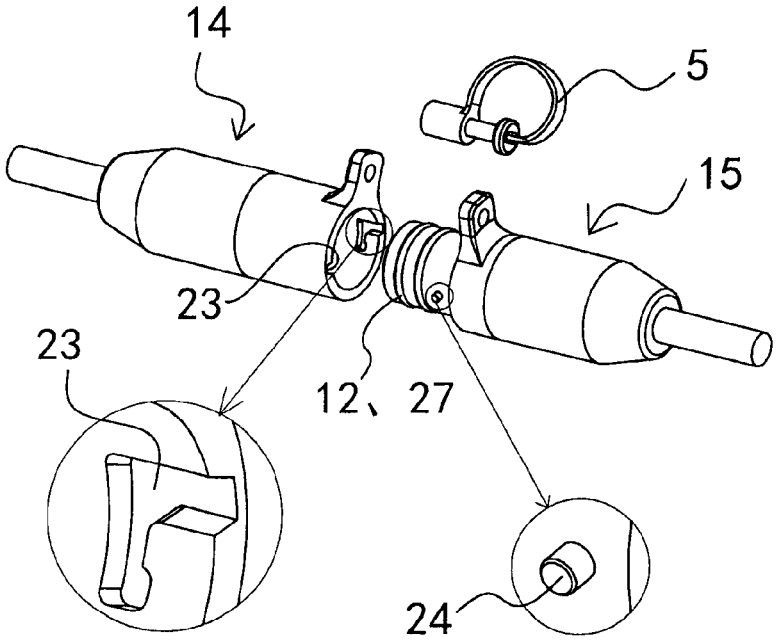
FIG. 19 is a stereoscopic drawing of the "L-shaped" guide slot and the convex guide pole according to the embodiment of the present invention.
Figure 20:
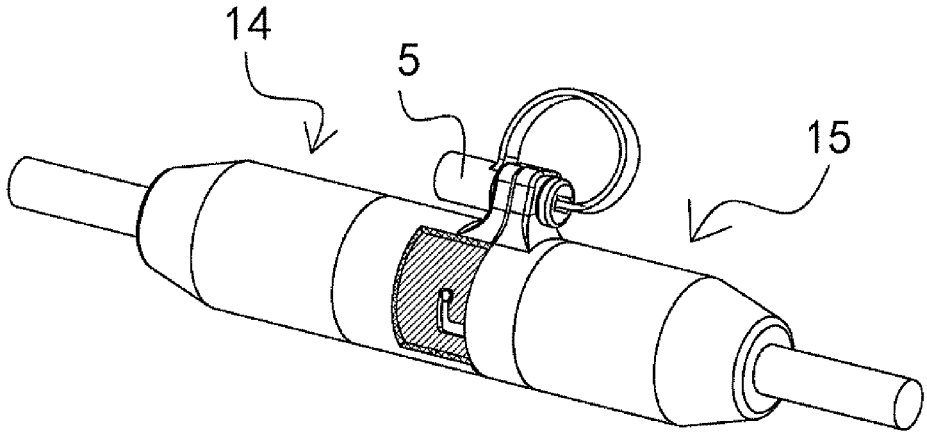
FIG. 20 is a stereoscopic drawing of the effect of the "L-shaped" guide slot fitted with the convex guide pole according to the embodiment of the present invention.
Figure 21:
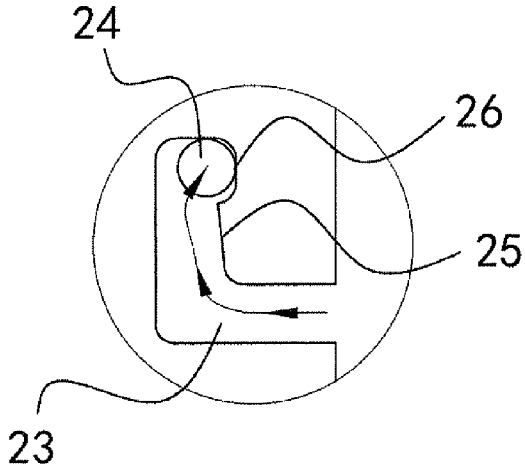
FIG. 21 is a schematic diagram of the "L-shaped" guide slot fitted with the convex guide pole according to the embodiment of the present invention.
Figure 22:
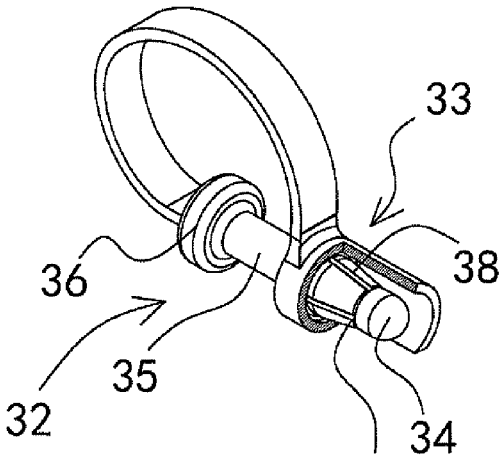
FIG. 22 is a stereoscopic drawing of the lock catch according to the embodiment of the present invention.
Figure 23:
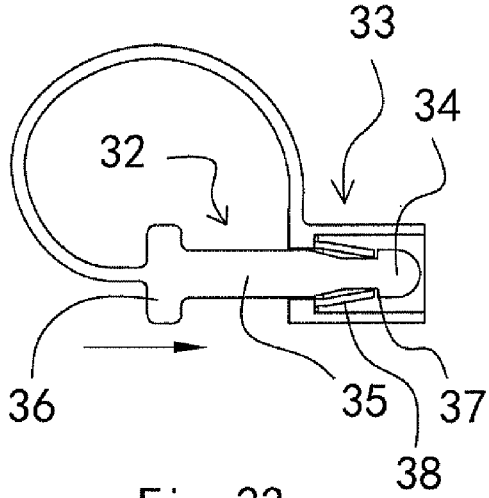
FIG. 23 is a schematic diagram of the lock catch according to the embodiment of the present invention.

As shown in FIGS. 19~21, when the male joint 14 is connected with the female joint 15, the convex guide pole 24 is in alignment with the axial guide slot of the "L-shaped" guide slot 23, making the cylindrical plug 18 inserted into the cylindrical hole 17 (see the action "A" in FIGS. 8 and 13). Meanwhile, the bar structure 20 of the connection portion of the male terminal 8 is inserted into the accommodation space 22 in front of the "U-shaped" opening of the female terminal 2. Here, with the male joint 14 and the female joint 15 pressing each other, the end-plane waterproof washer 6 forms the end-plane waterproof seal between the bottom of the cylindrical hole 17 and the end plane of the cylindrical plug 18. The two "O-shaped" waterproof rings 12 form the peripheral waterproof seal between the internal wall of the cylindrical hole 17 and the external edge of the cylindrical plug 18. When the cylindrical plug 18 is rotated clockwise by an azimuth relative to the cylindrical hole 17 (see the action "B" in FIGS. 8 and 13), the convex guide pole 24 glides along the peripheral guide slot of the "L-shaped" guide slot 23, and meanwhile the bar structure (20) of the connection portion of the five male terminals 8 is correspondingly embedded laterally from the connection portion of the five female terminals 2 into the "U-shaped" structure (21) to form the electrical connection (see FIGS. 18 and 15).

Figure 17:
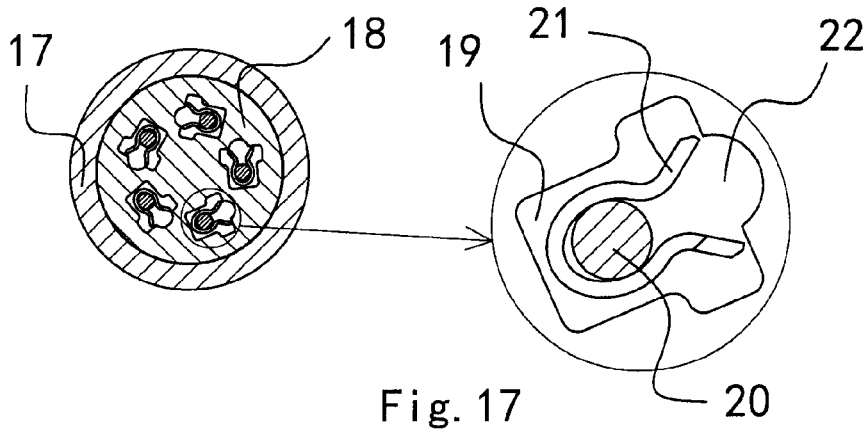
FIG. 17 is a sectional view at the terminal connection site of the male and the female joints according to the embodiment of the present invention after the assembly is finished.
Figure 18:
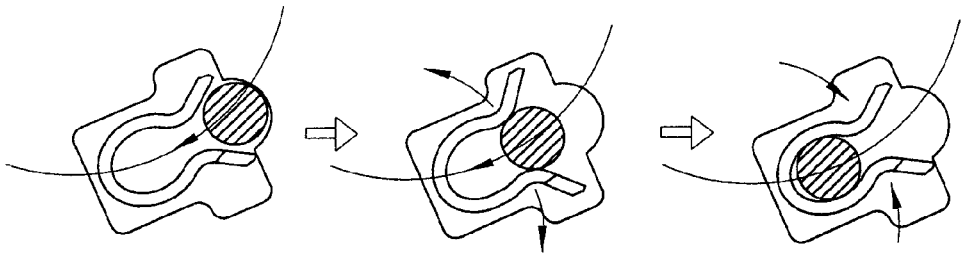
FIG. 18 is a schematic diagram of a pair of the male and the female terminals according to the embodiment of the present invention during the connection process.

In this embodiment, the five male terminals 8 and the five female terminals 2 are all positioned evenly in a peripheral direction with the same diameter. Actually, being positioned in a peripheral direction with the same diameter is a necessary condition, while being evenly positioned in the peripheral direction not a necessary condition. In other words, they can be positioned evenly or unevenly in the peripheral direction. The evenly-positioned case is shown in FIG. 17. It can be seen from the left drawing of FIG. 17 that five pairs of the terminals are evenly positioned in the peripheral direction. If any one or two pairs of the five pairs of the terminals are removed, the terminals remained in the peripheral direction are unevenly positioned. Thus this solution is obviously not feasible.

In this embodiment, in order to improve the function of the guide connection structure, the "L-shaped" guide slot 23 and the convex guide pole 24 are composed of two pairs (there can also be more, with at least one pair theoretically), each pair of them being composed of one "L-shaped" guide slot 23 and one convex guide pole 24, two pairs of the "L-shaped" guide slots 23 and the convex guide poles 24 being positioned evenly in a peripheral direction.

In this embodiment, in order to improve the fitting effect of the "L-shaped" guide slot and the convex guide pole in the guide connection structure, the guide side of the peripheral guide slot is designed as an inclined plane 25 (see FIG. 21), whose direction of turning forces the bottom of the cylindrical hole 17 and the end plane of the cylindrical plug 18 to press tightly against the end-plane waterproof washer 6, so as to improve the waterproof effect of the end plane. In addition, the peripheral guide slot is provided at its end with a concave portion 26 (see FIG. 21) for positioning the convex guide pole 24, so as to prevent the convex guide pole 24 from loosing.

In this embodiment, in order to prevent others from illegally disassembling the electrical connector, a lock catch mechanism is provided between the male joint and the female joint to lock the electrical connector (see FIGS. 8 and 9). This lock catch mechanism is specifically as below: The male joint 14 is provided with a male lock ear 28 extended radially at the external edge (see FIG. 8), and the male lock ear 28 with a male lock hole 29. The female joint 15 is provided with a female lock ear 30 extended radially at the external edge (see FIG. 8), and the female lock ear 30 with a female lock hole 31. There is a lock catch 6 mainly composed of a lock bolt 32 and a lock tube 33 (see FIGS. 22 and 23), the lock bolt 32 being composed sequentially in a length direction of three integral sections of a lock head 34, a lock rod 35 and a lock seat 36; a shaft shoulder 37 is positioned where the lock head 34 is connected with the lock rod 35 to prevent the lock head 34 from receding; the lock tube 33 is mainly of a sleeve structure, inside which are positioned four sectional jaws 38 (theoretically at least two jaws). After the lock head 34 of the lock bolt 32 goes through the male lock hole 29 and the female lock hole 31 and is inserted into the sleeve of the lock tube 33, the jaw 38 is caught at the shaft shoulder 37 behind the lock head 34, thus forming a lock catch mechanism preventing the lock bolt 32 from receding.

In this embodiment, in order to prevent the male joint 14 and the female joint 15 from being polluted with such impurities as dust and water vapor in a disassembly state, the male joint 14 is provided with a male dustproof plug 10 (see FIGS. 6 and 7), which is mainly composed of a plug body, which is plugged into the cylindrical hole 17 of the male joint 14 to form a seal structure. The female joint 15 is provided with a female dustproof cover 13 (see FIGS. 4 and 5), which is mainly composed of a sleeve cover with one end sealed, the sleeve cover being sleeved on the cylindrical plug 18 of the female joint 15 to form a seal structure. When the male joint 14 is connected with the female joint 15, the male dustproof plug 10 and the female dustproof cover 13 are then opened, respectively.

The above embodiment is used only for explaining the technical concept and characteristics of the present invention. It is provided to make those skilled in the art understand the present invention and implement it, and cannot thereby limit the extent of protection of the present invention. All equivalent changes or modifications according to the spirit of the present invention should fall within the extent of protection of the present invention.

What is claimed is:

1. A quick-connection outdoor waterproof electrical connector, comprising a male joint and a female joint;

the male joint is provided at its connection end with a concave cylindrical hole for connection, inside which is positioned a male bar terminal in parallel with an axis of the cylindrical hole, the male bar terminal being suspended at its head in the cylindrical hole and fixed at its base in the male joint;

the female joint is provided at its connection end with a convex cylindrical plug fittedly connected with the cylindrical hole, the cylindrical plug being provided inside with a terminal mounting hole in parallel with the axis, the terminal mounting hole being provided inside with a female bar terminal; and the male terminal and the female terminal are provided in pairs, with at least two pairs;

wherein:

on the radial section of the cylindrical hole, all the male terminals are positioned in a peripheral direction with a center of the cylindrical hole as a center of a circle; and on a radial section of the cylindrical plug, all the female terminals are positioned in a peripheral direction with a center of the cylindrical plug as a center of a circle; and the periphery where the male terminal is positioned has the same diameter with that where the female terminal is positioned;

a connection portion of the male terminal is of a bar structure, while the female terminal is provided at its connection portion with a "U-shaped" opening for the bar structure to be embedded laterally, the "U-shaped" opening being counterclockwise or clockwise in the tangent direction of the periphery where the female terminal is positioned, the terminal mounting hole being provided opposite to the "U-shaped" opening with an accommodation space for the bar structure to be inserted axially;

for an internal wall of the cylindrical hole and an external edge of the cylindrical plug, one of the internal wall and the external edge is provided with an "L-shaped" guide slot composed of an axial guide slot connected to a peripheral guide slot, and the other of the internal wall and the external edge is provided with a convex guide pole;

the cylindrical hole is provided at its bottom with an end-plane waterproof washer; and when the male joint is connected with the female joint, the convex guide pole is in alignment with the axial guide slot of the "L-shaped" guide slot, making the cylindrical plug inserted into the cylindrical hole; meanwhile, the bar structure of the connection portion of the male terminal is inserted into the accommodation space in front of the "U-shaped" opening of the female terminal; here, with the male joint and the female joint pressing each other, the end-plane waterproof washer forms the end-plane waterproof seal between the bottom of the cylindrical hole and the end plane of the cylindrical plug; and when the cylindrical plug is rotated counterclockwise or clockwise by an azimuth relative to the cylindrical hole, the convex guide pole glides along the peripheral guide slot of the "L-shaped" guide slot, and meanwhile the bar structure of the connection portion of the male terminal is embedded laterally from the connection portion of the female terminal into the "U-shaped" structure to form an electrical connection.

2. The quick-connection outdoor waterproof electrical connector according to claim 1, wherein the "L-shaped" guide slot and the convex guide pole are composed of at least two pairs, each pair being composed of one "L-shaped" guide slot and one convex guide pole, at least two pairs of the "L-shaped" guide slots and the convex guide poles being positioned evenly in a peripheral direction.

3. The quick-connection outdoor waterproof electrical connector according to claim 2, wherein a guide side of the peripheral guide slot is an inclined plane, whose direction of turning forces the bottom of the cylindrical hole and the end plane of the cylindrical plug to press tightly against the end-plane waterproof washer; and the peripheral guide slot is provided at its end with a concave portion for positioning the convex guide pole.

4. The quick-connection outdoor waterproof electrical connector according to claim 1, wherein between the internal wall of the cylindrical hole and the external edge of the cylindrical plug is an "O-shaped" waterproof ring, which is positioned in an annular concave slot located in one of the internal wall of the cylindrical hole and the external edge of the cylindrical plug, and forms a peripheral waterproof seal by being in contact with the other of the internal wall of the cylindrical hole and the external edge of the cylindrical plug.

5. The quick-connection outdoor waterproof electrical connector according to claim 1, wherein a male lock ear, provided with a male lock hole, is extended in a radial direction along the external edge of the male joint; a female lock ear, provided with a female lock hole, is extended in the radial direction along the external edge of the female joint; a lock catch is mainly composed of a lock bolt and a lock tube, the lock bolt being composed sequentially in a length direction of three integral sections of a lock head, a lock rod and a lock seat; a shaft shoulder is positioned where the lock head is connected with the lock rod to prevent the lock head from receding; the lock tube is mainly of a sleeve structure, inside of which are positioned at least two sectional jaws; and after the lock head of the lock bolt goes through the male lock hole and the female lock hole and is inserted into the sleeve of the lock tube, a jaw is caught at the shaft shoulder behind the lock head, thus forming a lock catch mechanism preventing the lock bolt from receding.

6. The quick-connection outdoor waterproof electrical connector according to claim 1, wherein the male joint is provided with a male dustproof plug, which is mainly composed of a plug body, which is plugged into the cylindrical hole of the male joint to form a seal structure; and the female joint is provided with a female dustproof cover, which is mainly composed of a sleeve cover with one end sealed, the sleeve cover being sleeved on the cylindrical plug of the female joint to form a seal structure.

7. The quick-connection outdoor waterproof electrical connector according to claim 1, wherein a guide side of the peripheral guide slot is an inclined plane, whose direction of turning forces the bottom of the cylindrical hole and the end plane of the cylindrical plug to press tightly against the end-plane waterproof washer; and the peripheral guide slot is provided at its end with a concave portion for positioning the convex guide pole.

* * * * *